US008454016B2

(12) United States Patent
Obuchi et al.

(10) Patent No.: US 8,454,016 B2
(45) Date of Patent: Jun. 4, 2013

(54) SHEET STACKING APPARATUS AND IMAGE FORMING APPARATUS

(75) Inventors: Yusuke Obuchi, Abiko (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/242,627

(22) Filed: Sep. 23, 2011

(65) Prior Publication Data

US 2012/0013069 A1 Jan. 19, 2012

Related U.S. Application Data

(63) Continuation of application No. 11/849,977, filed on Sep. 4, 2007, now Pat. No. 8,096,553.

(30) Foreign Application Priority Data

Sep. 6, 2006 (JP) ..... 2006-242075
Aug. 21, 2007 (JP) ..... 2007-214885

(51) Int. Cl.
*B65H 39/10* (2006.01)

(52) U.S. Cl.
USPC ..... 271/298; 271/299; 271/300; 271/215

(58) Field of Classification Search
USPC ..... 271/292, 296, 298, 300, 193, 196, 271/204, 215, 299
See application file for complete search history.

(56) References Cited

U.S. PATENT DOCUMENTS

| | | | | |
|---|---|---|---|---|
| 3,106,393 | A | 10/1963 | Koch | |
| 3,500,999 | A * | 3/1970 | Lippke | 209/587 |
| 3,690,646 | A | 9/1972 | Kolibas | |
| 5,671,920 | A * | 9/1997 | Acquaviva et al. | 271/307 |
| 6,991,229 | B2 * | 1/2006 | Yamakawa et al. | 271/223 |
| 2005/0006840 | A1 | 1/2005 | Kusaka | |

FOREIGN PATENT DOCUMENTS

| | | | |
|---|---|---|---|
| JP | 01-132648 | U | 9/1989 |
| JP | 06-074108 | B2 | 9/1994 |
| JP | 07-012366 | Y2 | 3/1995 |
| JP | 09-216761 | A | 8/1997 |

* cited by examiner

*Primary Examiner* — Michael McCullough
(74) *Attorney, Agent, or Firm* — Canon USA Inc. IP Division

(57) ABSTRACT

A sheet stacking apparatus includes a gripper configured to discharge a sheet, a plurality of stacker trays arranged in a row and configured to stack the discharged sheet, and a guiding unit configured to guide the discharged sheet to a predetermined position. The plurality of stacking trays are horizontally arranged so that a large number of sheets can be stacked without increasing the size of the sheet stacking apparatus.

10 Claims, 16 Drawing Sheets

SHEET STACKING APPARATUS AND IMAGE FORMING APPARATUS

CROSS-REFERENCE TO RELATED APPLICATIONS

This application is a continuation of U.S. patent application Ser. No. 11/849,977 filed Sep. 4, 2007, which claims priority from Japanese Patent Application Nos. 2006-242075 filed Sep. 6, 2006 and 2007-214885 filed Aug. 21, 2007, all of which are hereby incorporated by reference herein in their entirety.

BACKGROUND OF THE INVENTION

1. Field of the Invention

The present invention relates to a sheet stacking apparatus configured to stack sheets with improved alignment in a sheet discharging direction and, more particularly to a sheet stacking apparatus configured to stack a large number of sheets effectively utilizing a space, and an image forming apparatus having such a sheet stacking apparatus.

2. Description of the Related Art

In recent years, advancement in image forming techniques has made image forming speed faster and an image forming apparatus configured to form an image on a sheet has become capable of discharging sheets from its main body in larger quantities at higher speed. Accordingly, a sheet stacking apparatus which is connected to the main body of the image forming apparatus and stacks sheets discharged from the apparatus main body is required to be capable of stacking a large number of sheets while maintaining precise stack alignment. A sheet stacking apparatus meeting such requests (hereinafter referred to as "stacker") is discussed in Japanese Patent Application Laid-Open No. 2006-124052.

This conventional stacker is shown in FIG. 16. The stacker 500 receives a sheet discharged from a main body of an image forming apparatus at an inlet roller 501 and then passes the sheet to a gripper 503 using a conveyance roller pair 502. The gripper 503 grips and conveys the sheet so that the leading edge of the sheet abuts against a leading edge stopper 504. At the leading edge stopper 504, the sheet is released from the gripper 503 and falls onto a stacker tray 505. At this time, the sheet falls between the leading edge stopper 504 and a trailing edge stopper 508 so that the leading edge and the trailing edge of the sheet on the stacker tray 505 are aligned. Further, if necessary, the sheet is aligned in the width direction (i.e., a perpendicular direction to the sheet conveyance) by a width alignment device (not shown) in order to align the end (side end) of the sheet. Furthermore, the sheets are pressed against the stacker tray 505 by a leading edge pressing member 506 and a trailing edge pressing member 507 in every predetermined number so that the stacked sheets do not interfere with the subsequent discharged sheet.

However, in the conventional stacker 500, a stacking space on the stacker tray 505 is adjusted to a maximum size of the sheet. Thus, in a case when a sheet of a smaller size is stacked, an area X shown in a broken line in FIG. 16 is left unused. Consequently, a dead space is made in the conventional stacker 500.

Further, a distance between the leading edge stopper 504 and the trailing edge stopper 508 of the conventional stacker 500 is set to be a few millimeters longer than the length of the sheet in the sheet conveying (discharging) direction so that the sheet easily falls between the stoppers. Accordingly, Sheet alignment of the conventional stacker 500 is inadequate since the sheet is stacked with a variation of a few millimeters between the stoppers.

However, if the aforementioned distance is precisely set to meet the length of the sheet to improve alignment, the sheet takes longer time to fall between the two stoppers due to contact with them.

Thus, in order to reduce falling time, the conventional stacker 500 presses the sheet against the stacker tray 505 with a hitting member.

However, the conventional stacker 500 has a problem that at least one of the leading edge and the trailing edge of the sheet rubs against the stoppers, thereby damages the sheet while being stacked on the stacker tray 505.

Also, it is possible that the sheet damaged by the stacker needs to re-form the image on the sheet, therefore, the productivity of the image forming apparatus having such a stacker has been poor.

SUMMARY OF THE INVENTION

The present invention is directed to provide a sheet stacking apparatus which is capable of stacking a large number of sheets while making best use of space.

According to an aspect of the present invention, the sheet stacking apparatus enhances alignment of the sheets by reducing damage on the discharged and stacked sheets.

Further, the present invention is directed to provide an image forming apparatus with improved image forming efficiency which includes the sheet stacking apparatus capable of stacking a large number of sheets.

According to yet another aspect of the present invention, the sheet stacking apparatus includes a plurality of stacking portions configured to stack the sheets, a discharging portion configured to discharge a sheet onto one of the plurality of stacking portions selectively, and a guiding unit configured to guide the sheet which has been discharged from the discharging portion to a predetermined position on the stacking portion selected from the plurality of stacking portions. The guiding unit can move according to the selected stacking portion.

According to another aspect of the present invention, the sheet stacking apparatus has the plurality of stacking portions arranged in a row, accordingly a large number of sheets can be stacked without making the apparatus larger.

Further, according to another aspect of the present invention, the sheet stacking apparatus allows the guiding unit to guide the sheet discharged onto the stacking portion to a downstream side of the sheet discharging direction so that the leading edge of the sheet is aligned at the predetermined position, which contributes to improving the alignment of the sheet.

Further, according to another aspect of the present invention, the sheet on the sheet stacking apparatus is aligned without rubbing the leading edge or the trailing edge of the sheet, thereby damage caused to the sheets is reduced.

Further, according to another aspect of the present invention, the sheet stacking apparatus discharges the sheet one after another from the discharging portion so that the sheet is stopped at the predetermined position, thus a large number of sheets can be stacked at a higher speed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

(An Image Forming Apparatus)

Figure 1:
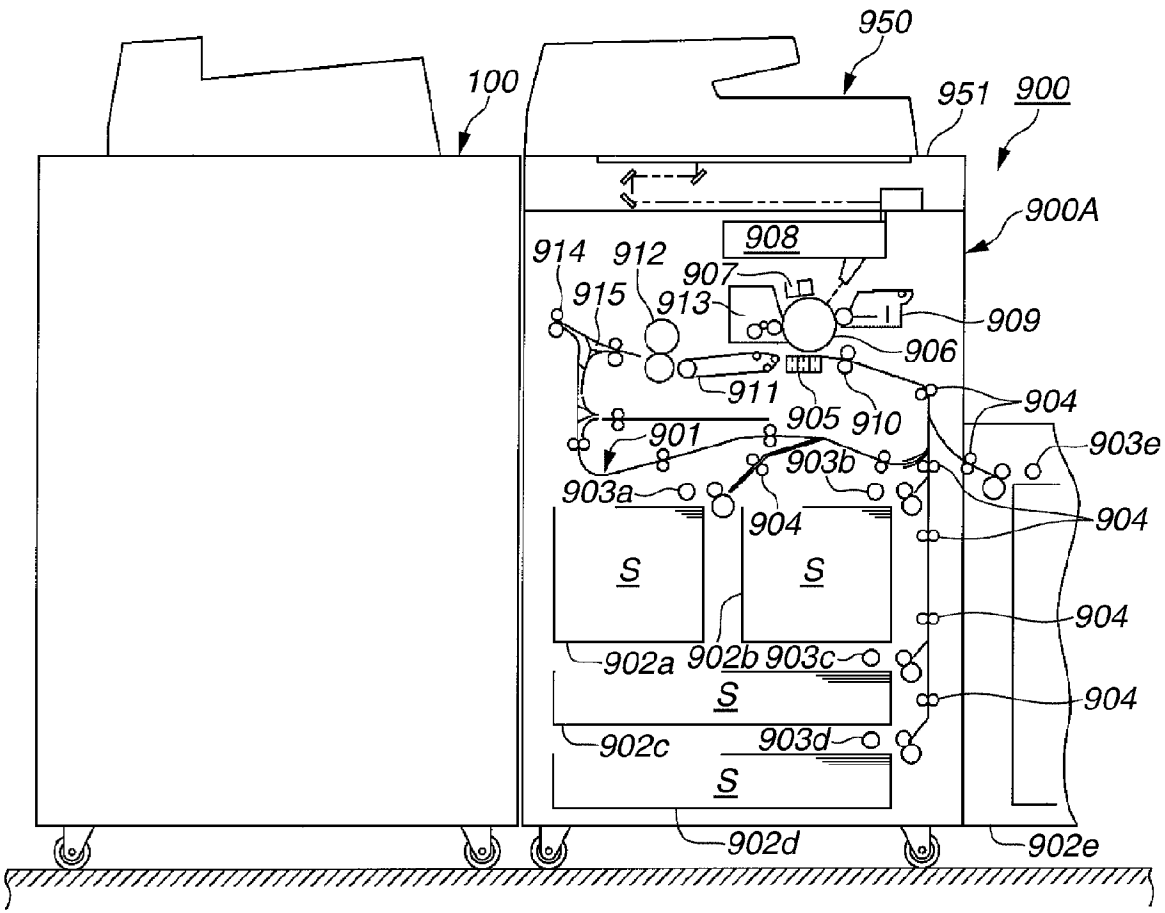
FIG. 1 is a cross-sectional view of an image forming apparatus in a sheet conveyance direction according to an exemplary embodiment of the present invention.

FIG. 1 is a cross-sectional view of an image forming apparatus in a sheet conveyance direction according to an exemplary embodiment of the present invention. An image forming apparatus 900 includes an apparatus main body 900A having a sheet stacking apparatus (hereinafter referred to as "stacker") 100. The stacker 100 can be optionally connected to the apparatus main body 900A, however, it can also be incorporated in the apparatus main body 900A.

The apparatus main body 900A has an image reader 951 and an auto document feeding apparatus 950 mounted on the top. A sheet S which is set on sheet cassettes 902*a* through 902*e* is conveyed to a registration roller pair 910 by feeding rollers 903*a* through 903*e* and by conveyance roller pairs 904.

A photosensitive drum 906 constitutes an image forming unit together with a transfer unit 905 which is described later and a developing unit 909. The photosensitive drum 906 is exposed by an exposure unit 908 when it is charged by a primary charging unit 907 so that digital data of the document scanned by the image reader 951 is formed as an electrostatic latent image. Then, the developing unit 909 performs toner-development on the photosensitive drum 906 and the electrostatic latent image becomes a toner image.

Subsequently, in synchronization with a position of the toner image, the sheet is conveyed by the registration roller pair 910 to a space between the photosensitive drum 906 and the transfer unit 905. Then the transfer unit 905 transfers the toner image from the photosensitive drum 906 to the sheet. Undesired matters such as toner which was not transferred to the sheet and remains on the photosensitive drum 906 are scraped off by a blade of a cleaning apparatus 913. As a result, the surface of the photosensitive drum 906 is cleaned and ready for the next image forming.

The sheet having the transferred toner image is conveyed by a conveying belt 911 to a fixing unit 912 where the toner image is fixed with heat and pressure sandwiched between a heating roller and a pressure roller of the fixing unit 912. The image-fixed sheet is then conveyed to the stacker 100 by a discharge roller pair 914 or conveyed to a reversing apparatus 901 by a flapper 915 to have a toner image formed on the other side of the sheet.

(A Control Block Diagram)

Figure 2:
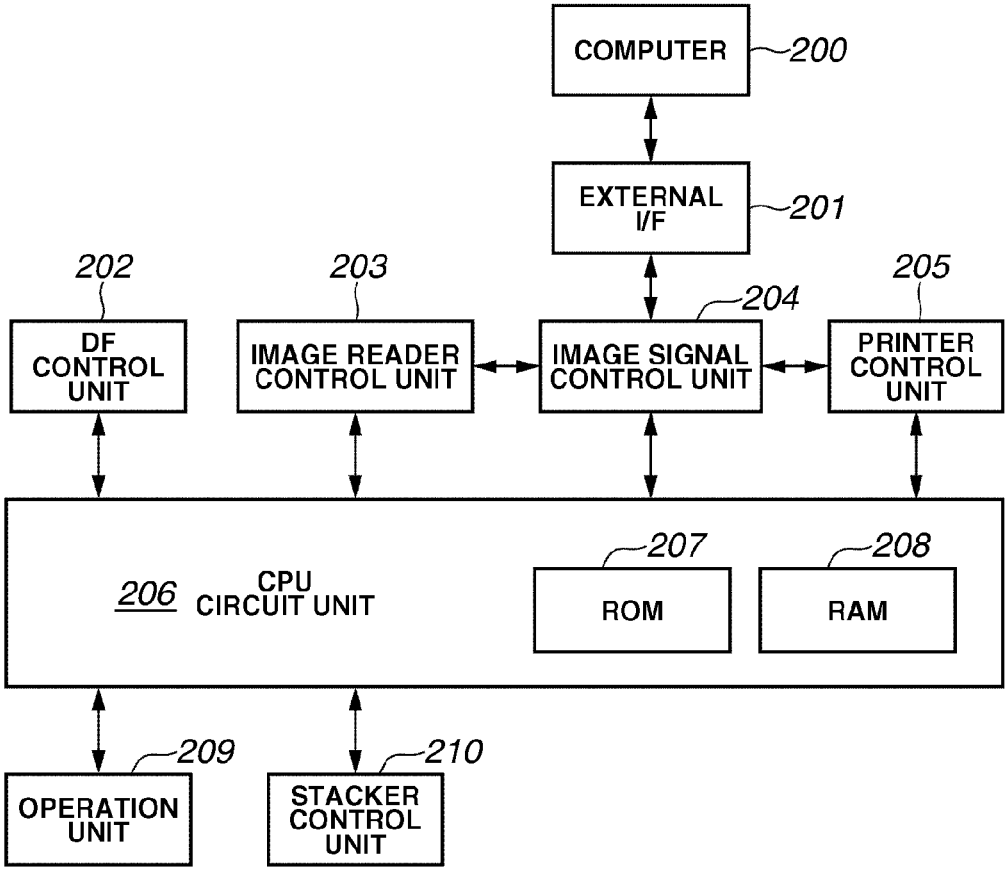
FIG. 2 is a block diagram illustrating control of the entire image forming apparatus including a sheet stacking apparatus.

FIG. 2 is a block diagram illustrating control of the entire image forming apparatus. A central processing unit (CPU) circuit unit 206 includes a CPU (not shown), a read only memory (ROM) 207, and a random access memory (RAM) 208. A control program stored in the ROM 207 controls blocks 201, 202, 203, 204, 205, 209, and 210 overall. The RAM 208 which temporarily stores control data is also used as a working area for processing control operations.

A document feeding (DF) control unit 202 controls drive of the auto document feeding apparatus 950 based on an instruction from the CPU circuit unit 206. An image reader control unit 203 controls drive of a scanner unit and an image sensor of the above described image reader 951. An analog image signal output from the image sensor is transmitted to an image signal control unit 204 by the image reader control unit 203.

The image signal control unit 204 converts the analog image signal output from the image sensor to a digital signal, processes and, converts it to a video signal, and outputs the video signal to a printer control unit 205 (i.e., a control unit of the apparatus main body). Further, the image signal control unit 204 variously processes a digital image signal input from a computer 200 through an external I/F 201 converting the image signal to a video signal, and outputs the converted video signal to the printer control unit 205. The processing performed by the image signal control unit 204 is controlled by the CPU circuit unit 206.

Based on the input video signal, the printer control unit 205 drives the above described exposure unit 908.

An operation unit 209 includes a plurality of keys adapted to set various functions concerning image forming and also a display unit adapted to display information showing a state of setting. The operation unit 209 outputs a key signal which corresponds to an operation of each key, to the CPU circuit unit 206. Further, the operation unit 209 displays information corresponding to a signal from the CPU circuit 206 on its display unit.

A stacker control unit 210 which is mounted on the stacker 100, performs control to drive the entire stacker by exchanging information with the CPU circuit unit 206. The control by the stacker control unit 210 will be described later.

(Basic Operations of the Stacker Apparatus)

Figure 3:
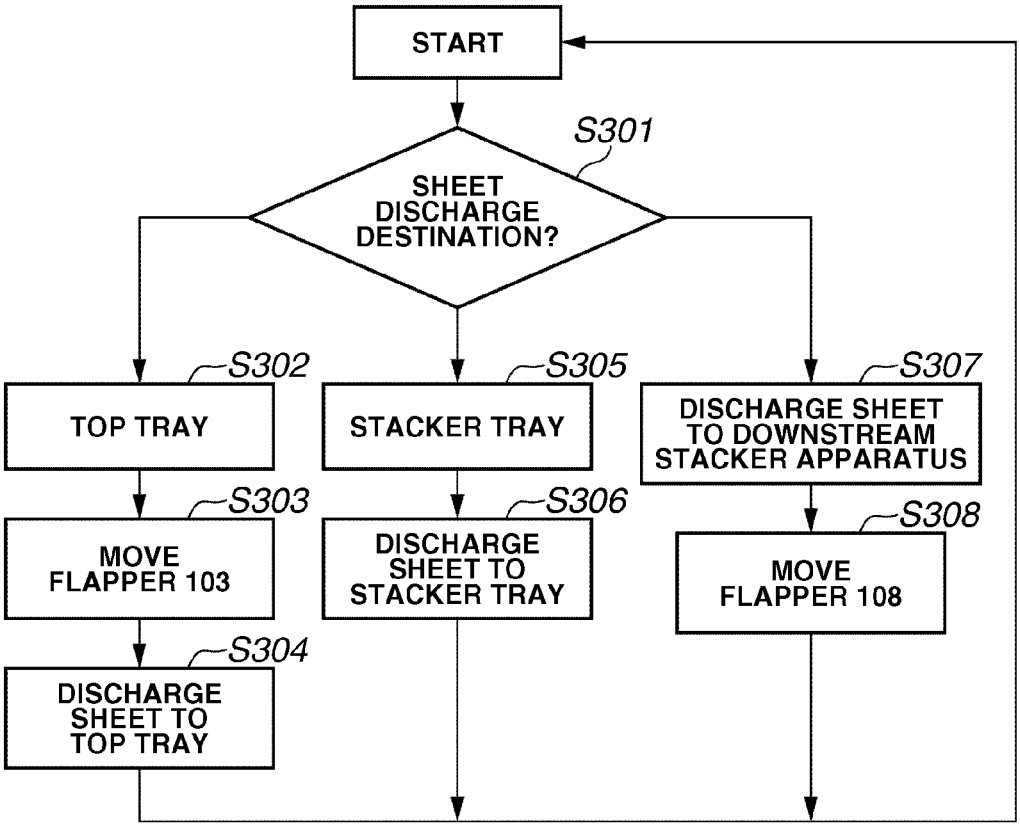
FIG. 3 is a flowchart illustrating basic operations of a stacker.
Figure 4:
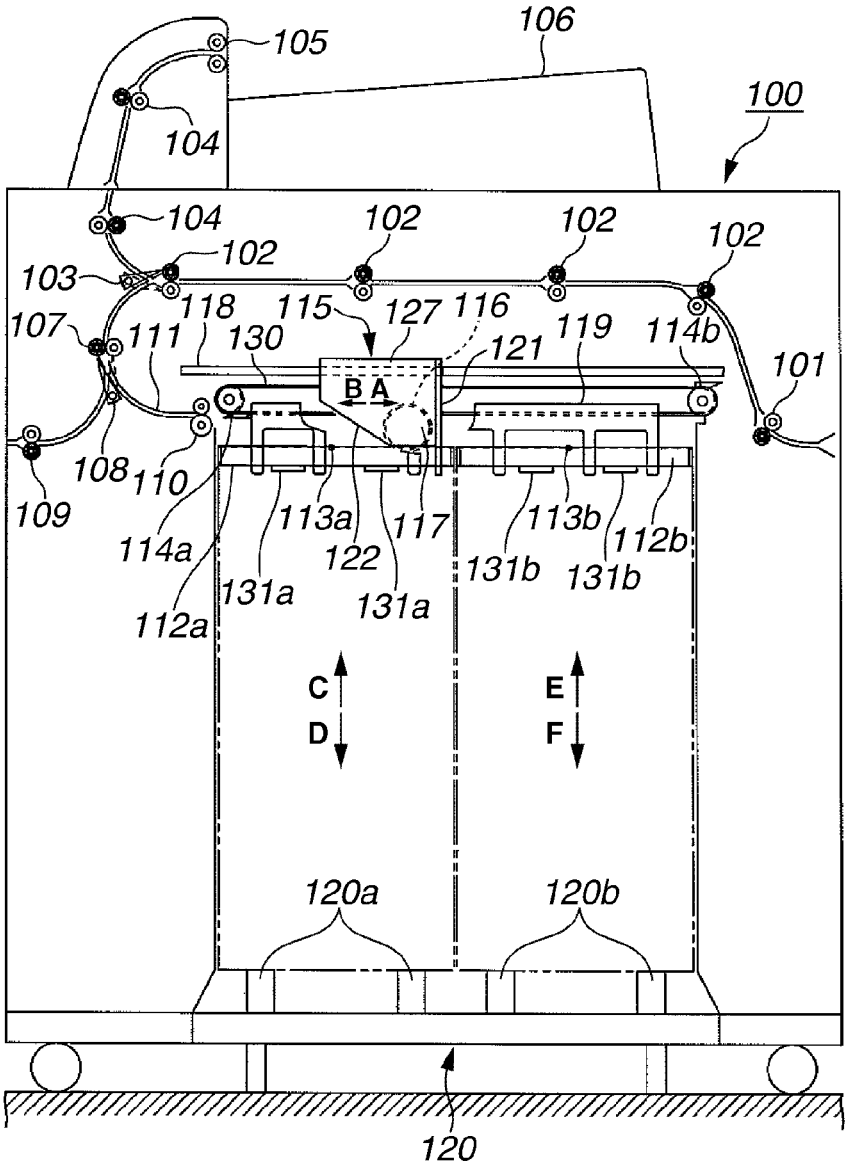
FIG. 4 is a cross-sectional view of the sheet stacking apparatus in a sheet conveyance direction according to an exemplary embodiment of the present invention.

Basic operations of the stacker will be described based on the flowchart shown in FIG. 3 and the cross-sectional view of the stacker illustrated in FIG. 4.

A sheet discharged from the apparatus main body 900A of the image forming apparatus 900 (FIG. 1) is conveyed to the stacker 100 by an inlet roller pair 101 of the stacker 100 and then conveyed to a switching flapper 103 by a conveyance roller pair 102. Before the sheet is conveyed, sheet information is sent to the stacker control unit 210 (FIG. 2) from the CPU circuit unit 206 of the image forming apparatus 900 (step S301). The sheet information includes sheet size, sheet type, and destination of the sheet.

When the destination of the sheet is a top tray 106 (step S302), the switching flapper 103 is switched by a solenoid (not shown) so that an edge of the flapper points downward as shown by a broken line (step S303), and the flapper 103 guides the sheet to a conveyance roller pair 104. The conveyed sheet is then discharged by a discharge roller pair 105 and stacked onto the top tray 106 (step S304).

When the destination of the sheet is the stacker tray 112*a* or 112*b* (step S305), the sheet conveyed by the conveyance roller pair 102 is guided by the switching flapper 103 which is switched by a solenoid (not shown) so that the edge of the flapper points upward as shown by a solid line, and then conveyed to a conveyance roller pair 107. Subsequently, the sheet is guided to a discharge roller pair 110 which constitutes a discharging portion with an outlet switching flapper 108. The outlet switching flapper 108 is switched so that its upper end points to the left direction as shown by a solid line. The discharge roller pair 110 passes the sheet onto grippers 114*a* and 114*b* which also constitute the discharging portion. Then, the sheet is selectively discharged and stacked onto the stacker tray 112*a* or 112*b* serving as a stacking portion (step S306). The discharge operation will be described below.

When the destination of the sheet is a stacker (not shown) located further downstream (step S307), the outlet switching flapper 108 is switched so that its upper end points in the right direction as shown in a broken line (step S308). Then, the sheet conveyed by the conveyance roller pair 102 is conveyed by the conveyance roller pair 107, and after being guided by an outlet roller pair 109, the sheet is conveyed to the stacker.

(Discharging Sheet on the Stacker Tray)

An operation of the stacker that discharges the sheet onto the stacker tray will now be described with reference to FIGS. 4 through 14. The stacker trays 112*a* and 112*b* are supported by supporting members 131*a* and 131*b* which are moved up and down by a driving apparatus (not shown). The stacker trays 112*a* and 112*b* are arranged so that they can move separately in the directions shown in arrows C, D, E, and F in FIG. 4.

A guiding unit 115 is mounted movably on a slide shaft 118, and a frame 127 of the guiding unit 115 is moved in the directions shown in arrows A and B by a driving apparatus (not shown). The frame 127 of the guiding unit 115 includes a stopper 121, a taper portion 122, and a knurled belt 116. The sheet is guided to the stopper 121 by the taper portion 122 and the leading edge of the sheet in a sheet discharging direction abuts against the stopper 121. The knurled belt 116 has elasticity and draws in the sheet to the stopper 121.

The taper portion 122 serving as a guide member and the knurled belt 116 serving as a rotating member constitute the guiding unit. The sheet guided by the taper portion 122 and the knurled belt 116 is aligned at a predetermined position when its leading edge in the sheet discharging direction abuts against the stopper 121.

The knurled belt 116 is rotated counterclockwise by a driving apparatus (not shown) and draws in the sheet between the knurled belt 116 and the stacker tray 112*a* (or the stacker tray 112*b*) so that the leading edge of the sheet abuts against the stopper 121. A sheet surface detection sensor 117 installed in the guiding unit 115 keeps a constant distance between the guiding unit 115 and the top surface of the sheet stack.

The grippers 114*a* and 114*b* which grip the leading edge of the sheet to convey the sheet are attached to a drive belt 130 while the grippers is urged in a gripping direction by a torsion coil spring (not shown). The sheet discharged by the discharge roller pair 110 is held by the gripper 114*a* or the gripper 114*b* into which the sheet is thrust. The gripper can be elastic bodies made of, for example, sponge on upper and lower sides of a V-shaped opening member and hold the sheet thrust into the upper and lower elastic bodies.

The stacker trays 112*a* and 112*b* serving as a stacking portion are trays on which the discharged sheets are stacked. These trays stand by at their home positions to stack the sheet according to home position detection sensors 113*a* and 113*b*.

Figure 5:
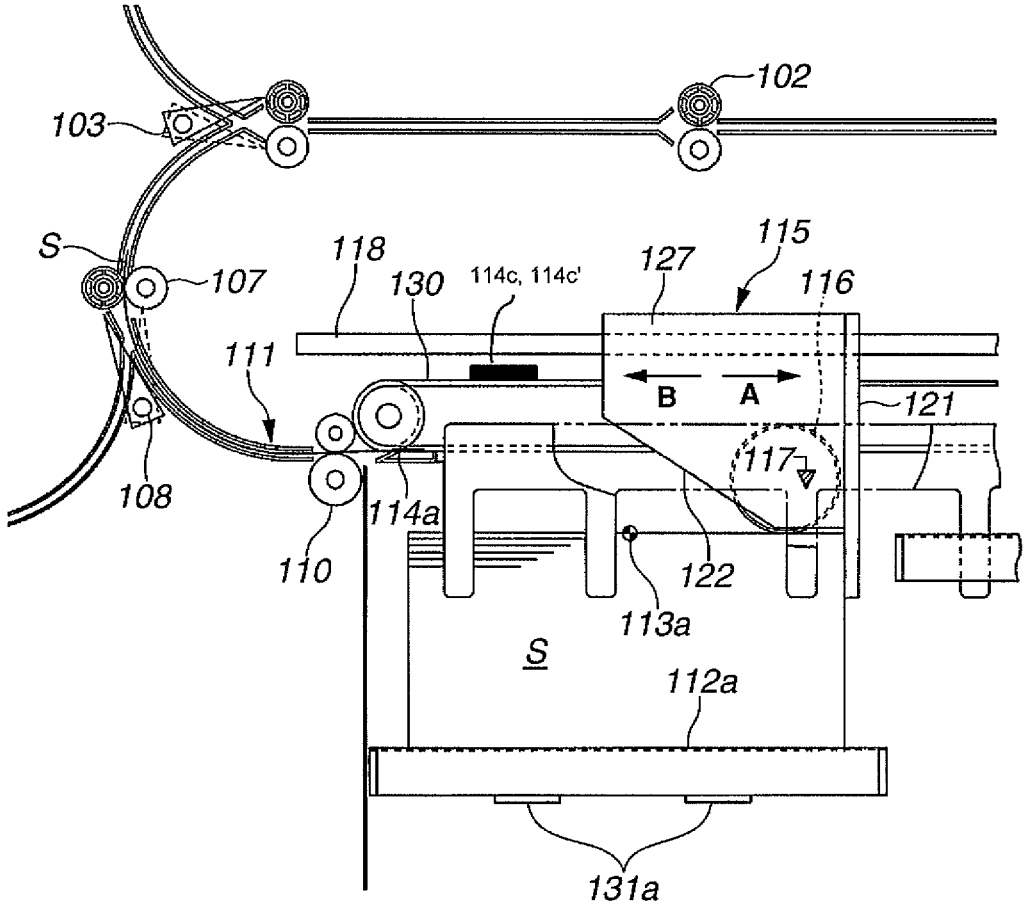
FIG. 5 illustrates a movement of a sheet when it is stacked on a stacker tray on the left. The sheet is held by a gripper.
Figure 6:
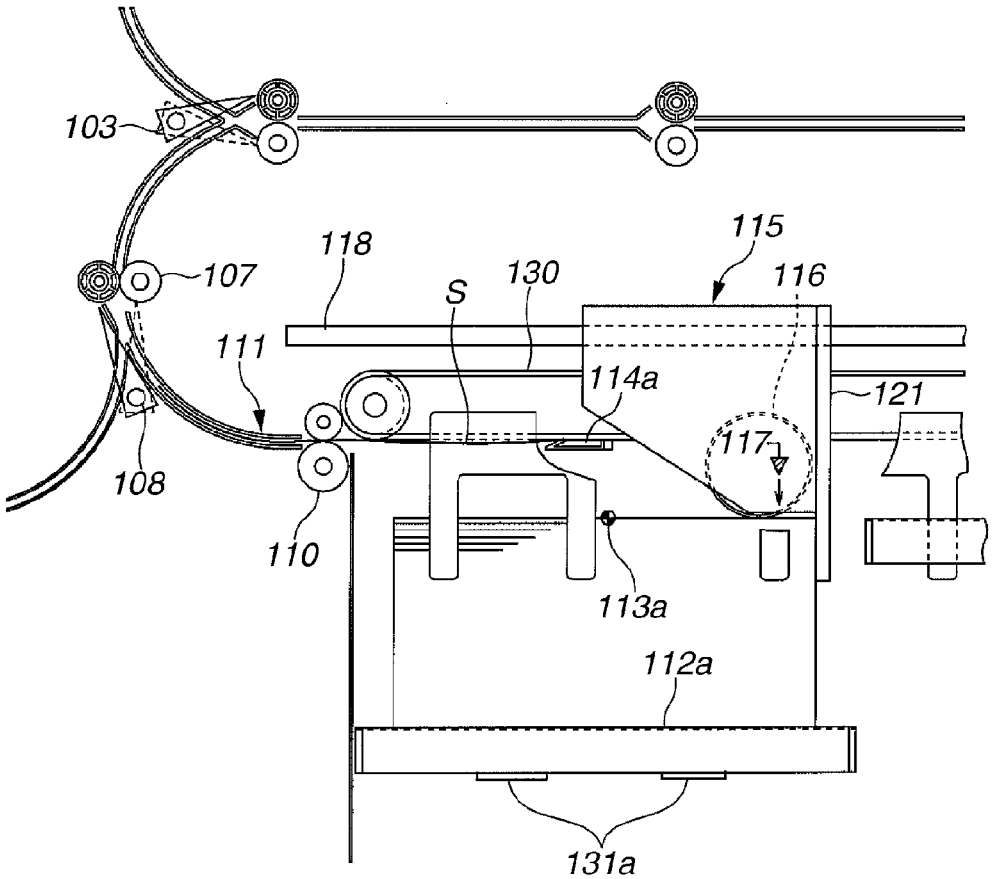
FIG. 6 sequentially follows FIG. 5 and illustrates the movement of the sheet. The sheet is conveyed and discharged to a guiding unit.

As shown in FIG. 5, the sheet S discharged from the apparatus main body 900A (FIG. 1) of the image forming apparatus 900 is conveyed to the discharge roller pair 110. Then, the passing timing of the leading edge of the sheet is detected by a timing sensor 111 located upstream of the discharge roller pair 110. At this timing, the drive belt 130 starts rotating so that the gripper 114*a* in a standby state conveys the sheet while gripping the leading edge of the sheet S. Then, the gripper 114*a* moves toward the guiding unit 115 while gripping the sheet (FIG. 6). The drive belt 130 and the grippers 114*a* and 114*b* constitute the discharging portion.

Figure 7:
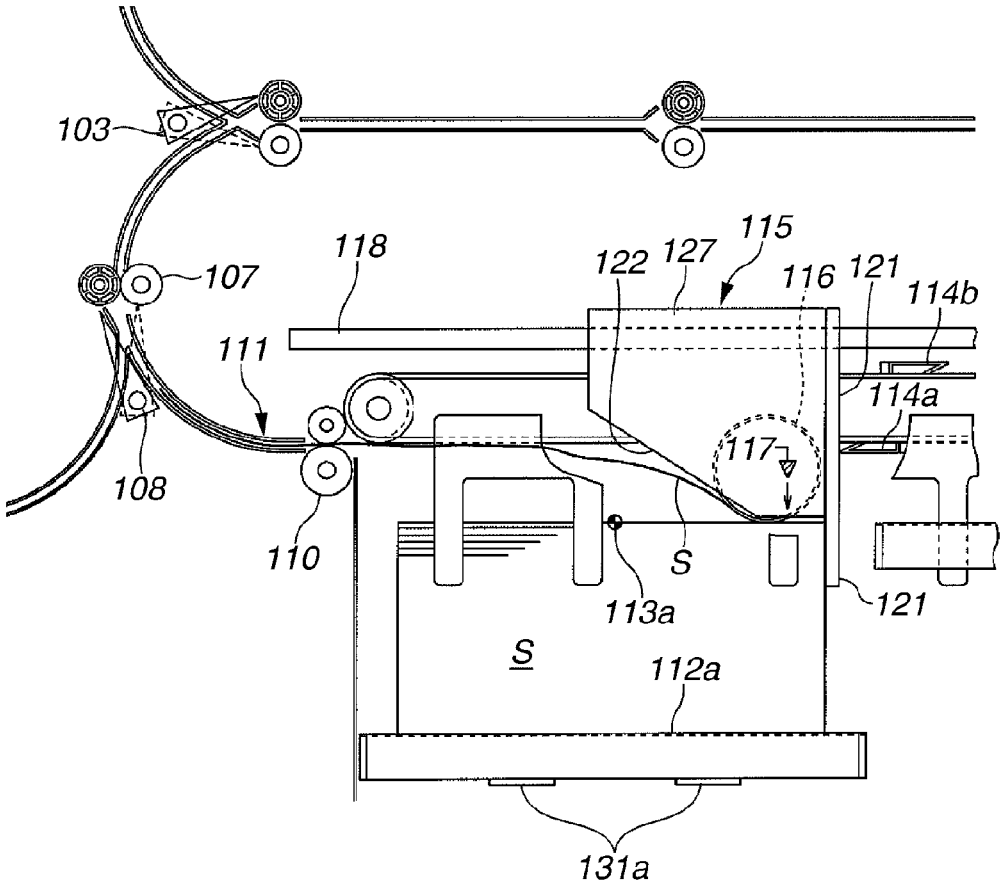
FIG. 7 sequentially follows FIG. 6 and illustrates the movement of the sheet. The sheet guided by a taper portion of the guiding unit is in a state just before stacking onto the sheets already stacked.
Figure 8:
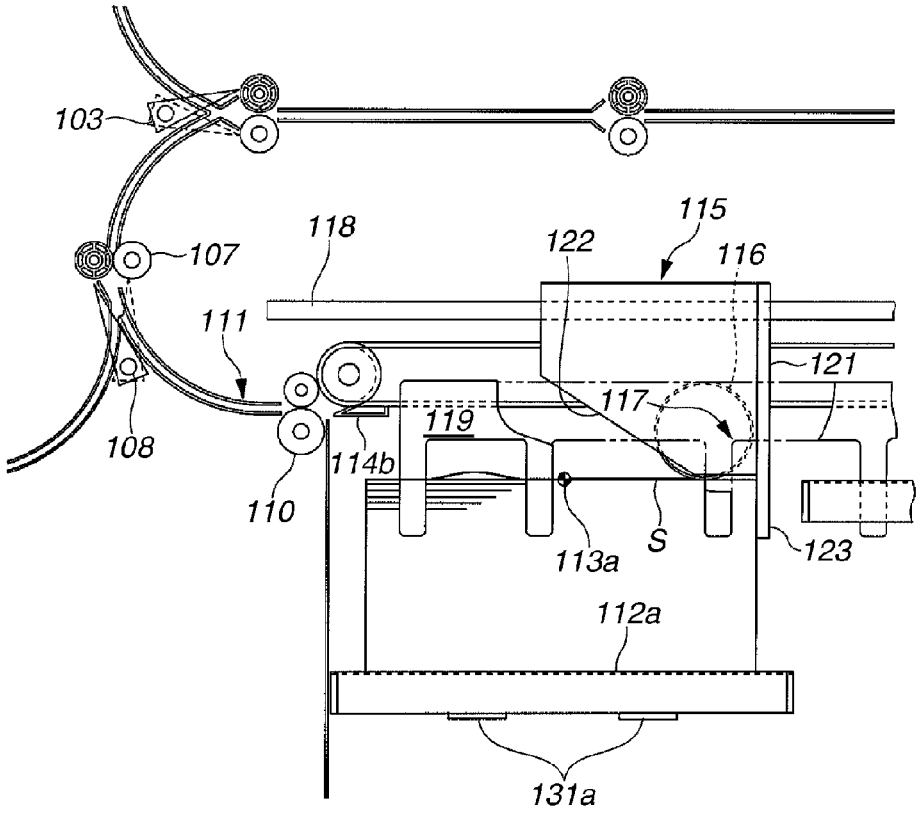
FIG. 8 sequentially follows FIG. 7 and illustrates the movement of the sheet. The sheet is stacked onto the sheets already stacked.

Then, as shown in FIG. 7, when the gripper 114*a* passes the taper portion 122 of the guiding unit 115, the sheet S is released from the gripper 114*a* and guided by the taper portion 122 to the stacker tray 112*a* by conveyance momentum. Then, the sheet proceeds in between the knurled belt 116 and the stacker tray 112*a* (or, onto a top of a sheet stack if a sheet is stacked). The sheet is conveyed by the knurled belt 116 until its leading edge in the sheet discharging direction abuts against the stopper 121 (FIG. 8). As a result, the sheet is stacked on the stacker tray 112*a* or on the top of the sheet stack with its leading edge aligned to the predetermined position.

Then, an alignment plate 119 jogs in a direction (sheet width direction) perpendicular to the sheet conveyance direction (sheet discharging direction), and aligns the side end of the sheets (width alignment).

The sheet surface detection sensor 117 continuously monitors the top surface of the sheet stack on the stacker tray 112*a*. When a distance between the knurled belt 116 of the guiding unit 115 and the sheet becomes less than a predetermined value, a driving apparatus (not shown) moves down the stacker tray 112*a* by the predetermined value. In this way, the distance between the sheet and the knurled belt 116 is maintained at the predetermined value.

The stacker 100 stacks the sheet one after another on the stacker tray 112*a* using the grippers 114*a* and 114*b* which convey and discharge the sheets alternately while the drive belt 130 circulates.

When it is detected that the sheets stacked on the stacker tray 112*a* reach a predetermined stack height, the stacker tray 112*a* is determined to be fully loaded. It is normally determined that the predetermined stack height is reached when the sheet S discharged from the discharge roller pair 110 is detected by the timing sensor 111 and counted by the stacker control unit 210 (FIG. 2). Whether the predetermined stack height is reached can also be determined by detecting the positions of the stacker tray 112*a* and the top surface of the sheet stack.

Figure 9:
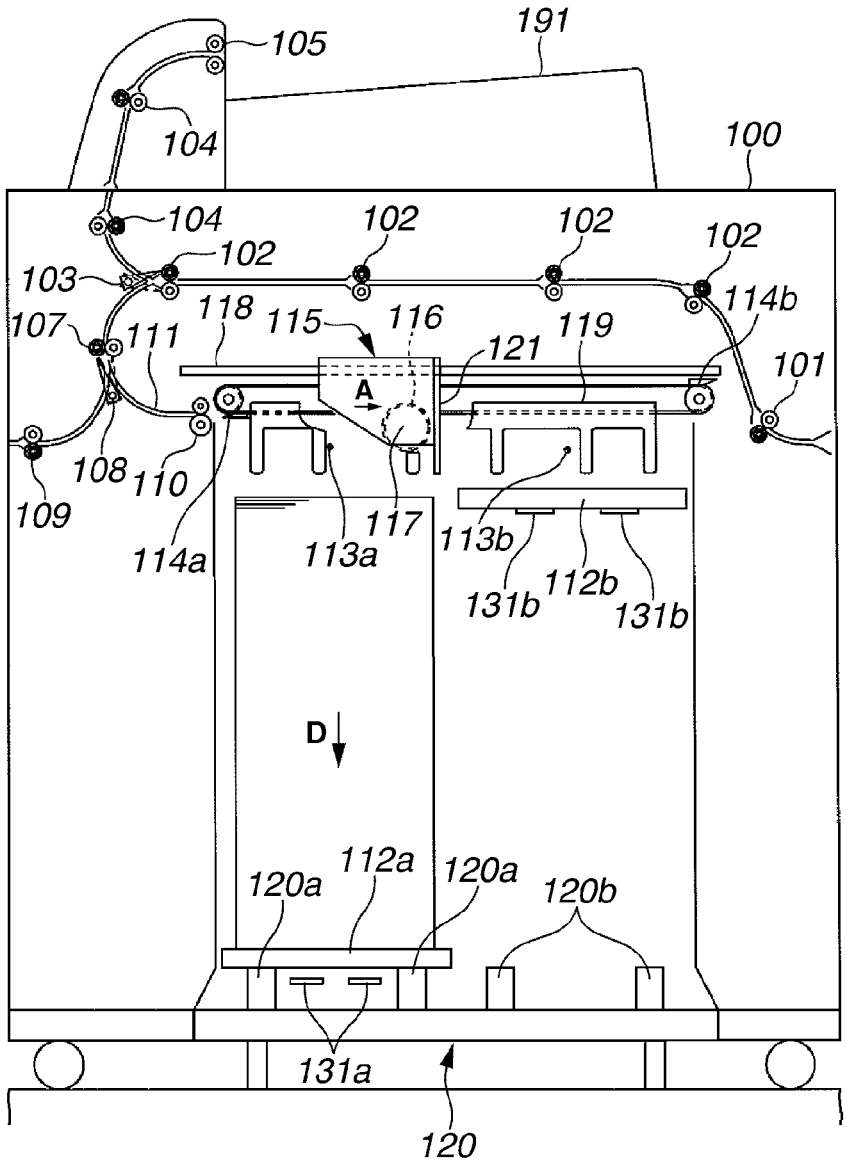
FIG. 9 sequentially follows FIG. 8 and illustrates the movement of the sheet. Sheets are stacked onto the stacker tray until a predetermined stack height is reached.

When the sheets on the stacker tray 112*a* reach the predetermined stack height, the stacker control unit 210 (FIG. 2) controls the stacker tray 112*a* to move down, and mounts the stacker tray together with the stacked sheets on the dolly 120 serving as a wagon as shown in FIG. 9. Then, the guiding unit 115 moves in the direction of the arrow A. The stacker tray 112*b* stands by until the sheets are stacked.

The standby position of the guiding unit 115 is preferably at about the center of the sheets stacked on the stacker trays 112*a* or 112*b* since the stacking condition will be well stabilized there. However, the standby position is not limited to the center so long as the stacked sheets are within an area of the stacker trays 112*a* and 112*b*.

Figure 10:
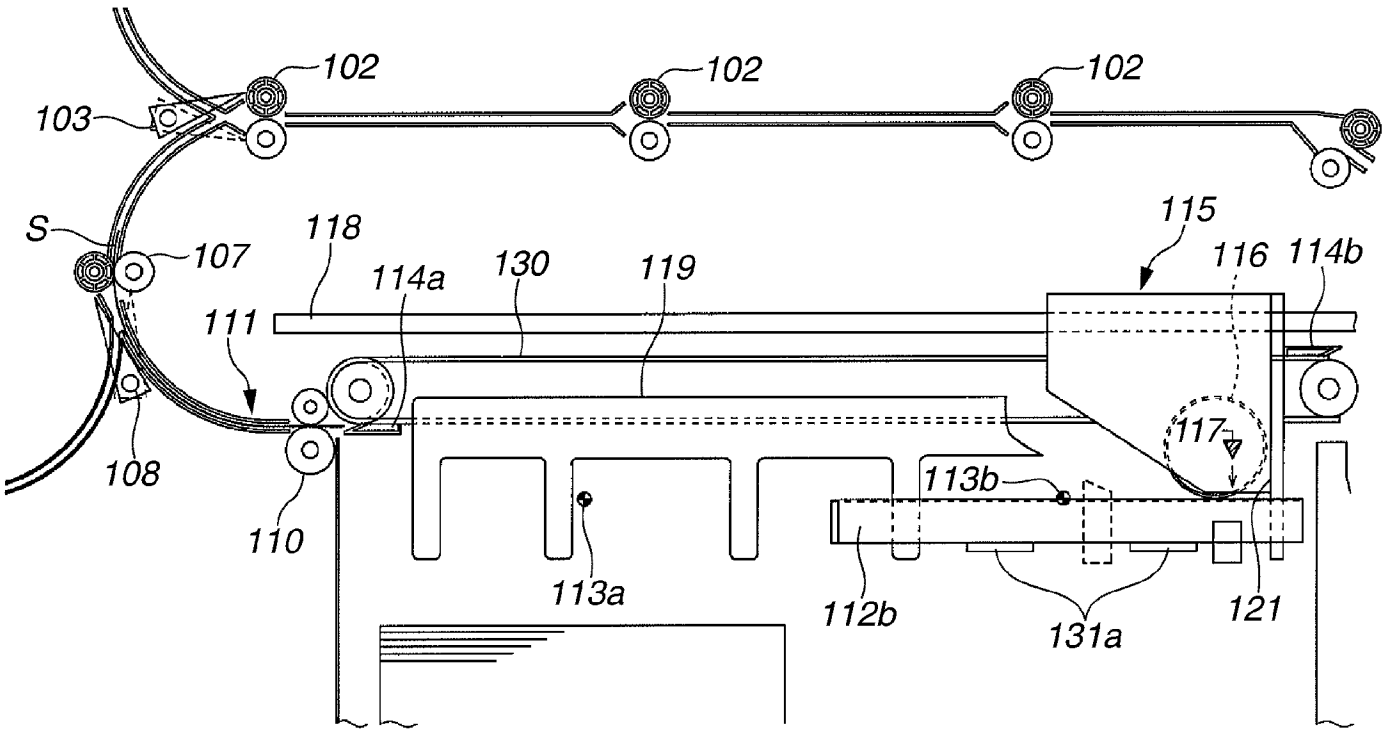
FIG. 10 illustrates the movement of the sheets when it is stacked onto the stacker tray on the right. The sheet is held by the gripper.
Figure 11:
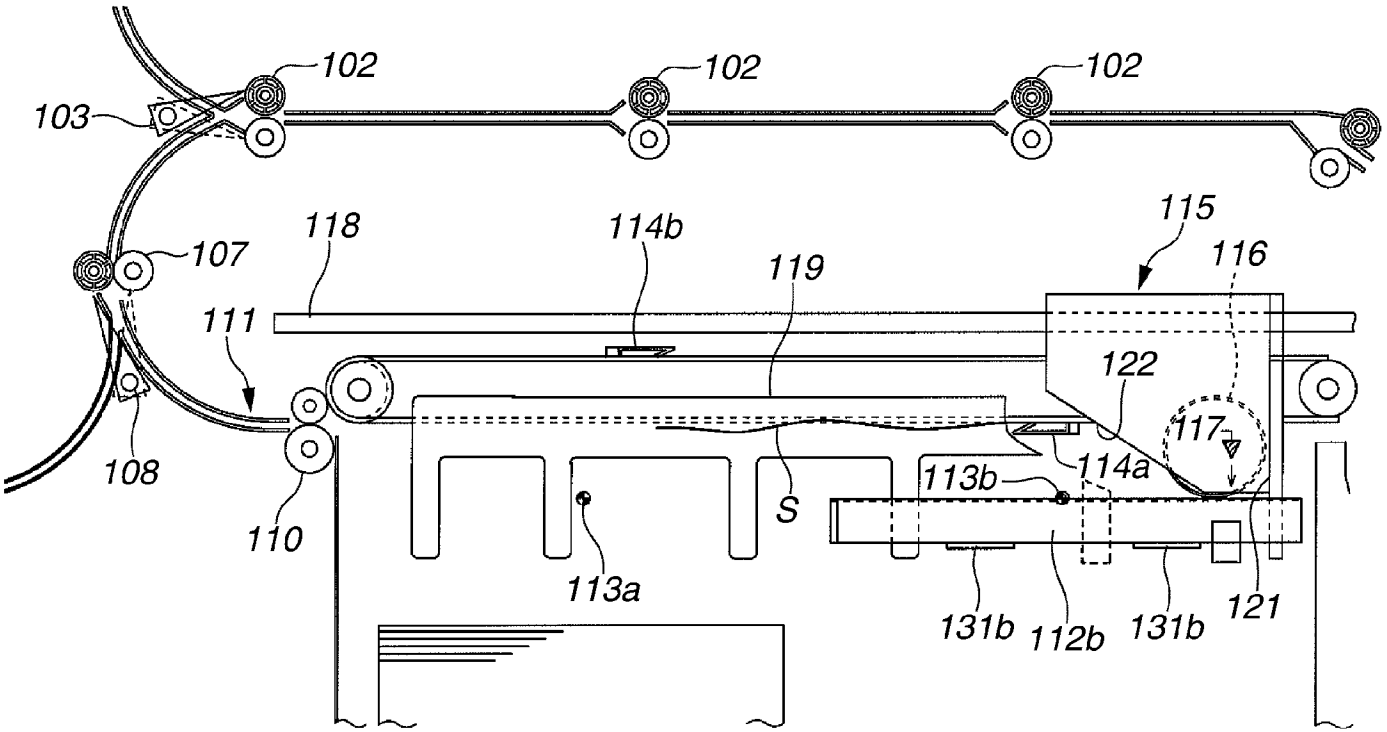
FIG. 11 sequentially follows FIG. 10 and illustrates the movement of the sheet. The sheet is conveyed and discharged to the guiding unit.
Figure 12:
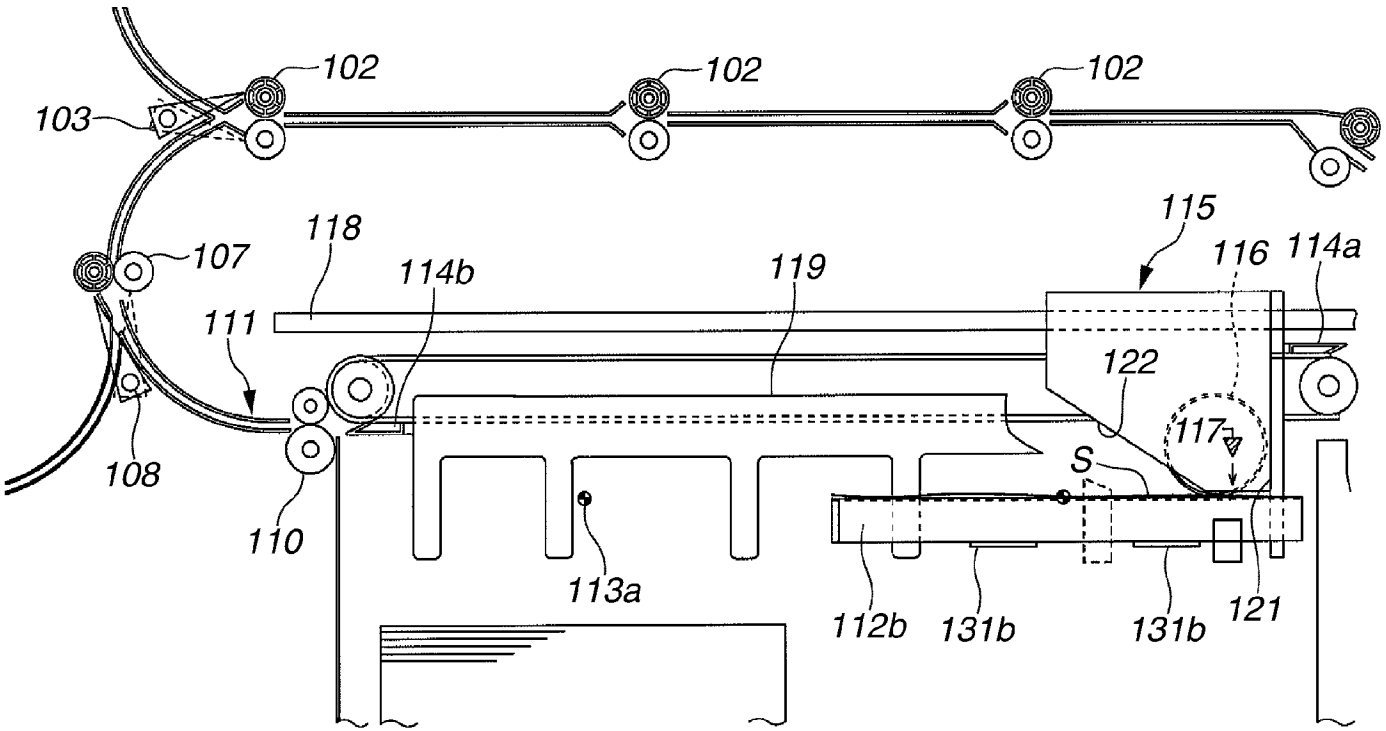
FIG. 12 sequentially follows FIG. 11 and illustrates the movement of the sheet. The sheet is stacked onto the stacker tray after being guided by the taper portion of the guiding unit.

As shown in FIG. 10, after the sheet discharged from the apparatus main body of the image forming apparatus passes through the timing sensor 111, the sheet is discharged from the discharge roller pair 110 and its leading edge is gripped by the gripper 114*a*. As shown in FIGS. 11 and 12, when the gripper 114*a* passes the taper portion 122 of the guiding unit 115, the leading edge of the sheet S is pushed toward the stacker tray 112*b* by the taper portion 122. Then, the sheet is conveyed along the taper portion 122 and lead to the knurled belt 116.

Then, the leading edge of the sheet S abuts against the stopper 121, driven by the knurled belt 116. The sheet S, with its leading edge in the sheet discharging direction aligned to the predetermined position, is stacked on the stacker tray 112*b*. Further, an alignment plate 119 aligns the side end of the sheet S.

The sheet surface detection sensor 117 continuously monitors the top surface of the sheet stack on the stacker tray 112*b*. When the distance between the knurled belt 116 of the guiding unit 115 and the sheet becomes less than the predetermined value, a driving apparatus (not shown) moves down the stacker tray 112*b* by the predetermined value. In this way, the distance between the sheet and the knurled belt 116 is maintained at the predetermined value The stacker 100 stacks the sheet one after another on the stacker tray 112*b* using the grippers 114*a* and 114*b* which convey and discharge the sheets alternately driven by the rotation of the drive belt 130.

When it is detected that the sheets stacked on the stacker tray 112*b* reach a predetermined stack height, the stacker tray 112*b* is determined to be fully loaded. It is normally determined that the predetermined stack height is reached when the sheet S discharged from the discharge roller pair 110 is detected by the timing sensor 111 and counted by the stacker control unit 210 (FIG. 2). Whether the predetermined stack height is reached can also be determined by detecting positions of the stacker tray 112*b* and the top surface of the sheet stack.

Figure 13:
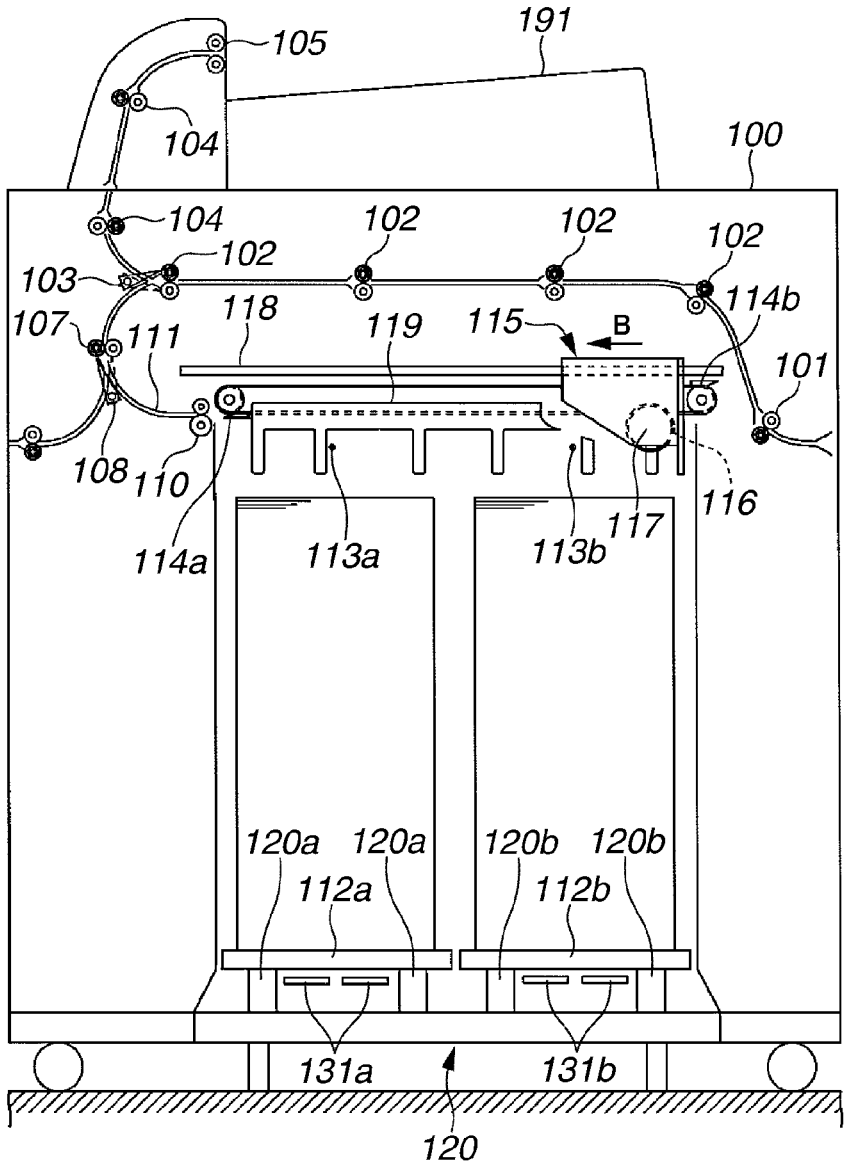
FIG. 13 sequentially follows FIG. 12 and illustrates the movement of the sheet. The sheets are stacked onto both stacker trays until the predetermined stack height is reached.

When the sheets on the stacker tray 112*b* reach the predetermined stack height, the stacker control unit 210 (FIG. 2) controls the stacker tray 112*b* to move down and mounts the stacker tray on the dolly 120 as shown in FIG. 13.

The guiding unit 115 moves in the direction of the arrow B and stands by above the stacker tray 112*a* on the left (i.e., the most upstream stacking portion).

Figure 14:
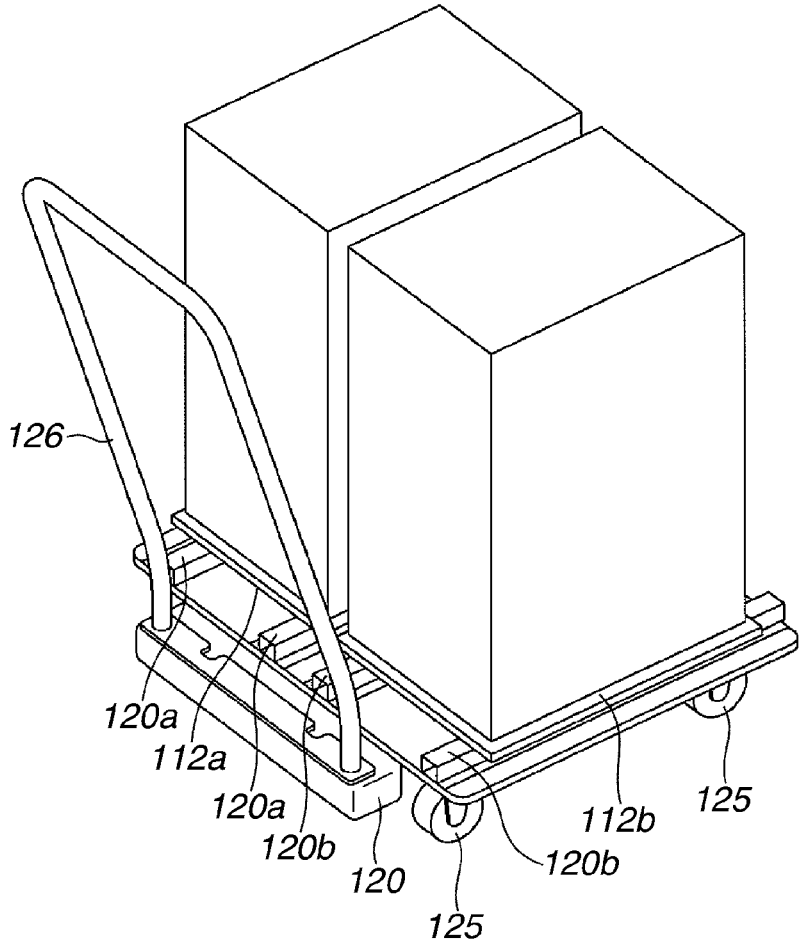
FIG. 14 is a perspective view of a dolly conveying the sheets.

The stacker trays 112*a* and 112*b* are supported by a pair of supporting members 131*a* and 131*b* which are moved up and down by a driving apparatus (not shown). The stacker trays 112*a* and 112*b* are passed onto the dolly 120 when the supporting members 131*a* and 131*b* move down below supporting surfaces 120*a* and 120*b* of the dolly 120. As shown in FIG. 14, the stacker trays 112*a* and 112*b* loaded with a large number of sheets are mounted on the dolly 120 using a fixing member (not shown) such as pins arranged on the top surface of the dolly 120 so that the sheets do not fall off the dolly 120. The dolly 120 includes casters 125 and a handle 126, therefore, the dolly 120 is moved by the user holding the handle 126 so that a large number of sheets can be easily carried at a time.

After the dolly 120 is carried out from the stacker 100, the stack of sheets on the stacker trays 112*a* and 112*b* on the dolly 120 are removed by the user. The stacker 100 is stopped until the dolly 120 is set at the bottom of the stacker 100 again. Alternatively, a spare dolly and spare stacker trays 112*a* and 112*b* can be prepared and set at the stacker 100. The spare stacker trays 112*a* and 112*b* can be supported by the pair of supporting members 131 so as to operate the stacker 100.

Figure 15:
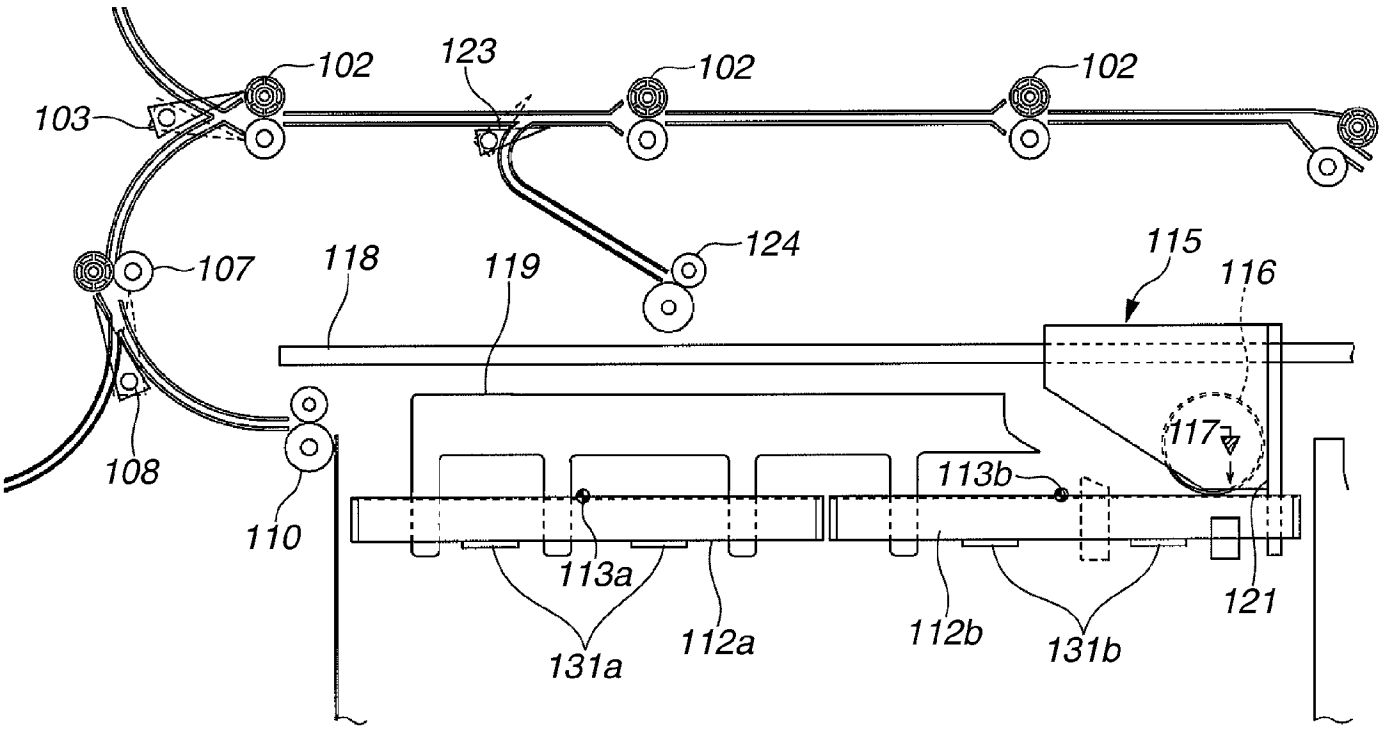
FIG. 15 illustrates the sheet stacking apparatus equipped with a sheet discharging portion in each stacker tray.
Figure 16:
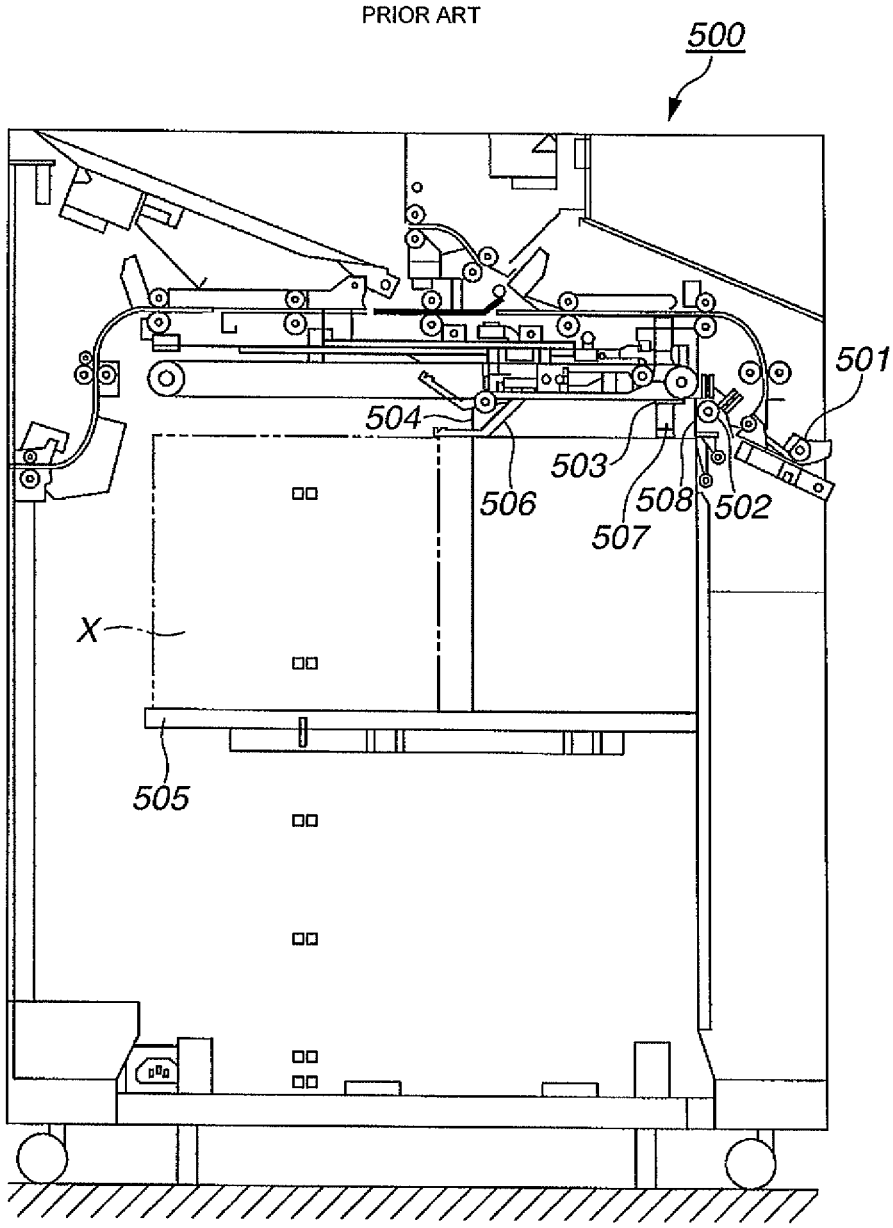
FIG.16 PRIOR ART
FIG. 16 is a cross-sectional view of a conventional sheet stacking apparatus in a sheet conveyance direction.

The stacker described above conveys the sheet to a plurality of stacker trays using grippers. However, as shown in FIG. 15, each stacker tray can be provided with the discharge roller pairs 110 and 124 serving as the discharging portion, and the sheet can be discharged from these roller pairs to each stacker tray.

That is to say, when sheets are stacked on the stacker tray 112*a*, the guiding unit 115 stands by above the stacker tray 112*a*. The sheet conveyed by the discharge roller pair 110 is discharged toward the guiding unit 115. When sheets are stacked on the stacker tray 112*b*, the guiding unit 115 stands by above the stacker tray 112*b*. The sheet conveyed by the discharge roller pair 124 is discharged toward the guiding unit 115. Whether the discharge roller pair 110 or the discharge roller pair 124 is used is selected by switching a flapper 123.

The stacker has two stacker trays, however, the stacker can have three or more stacker trays.

The sheet is conveyed by the gripper which grips the leading edge of the sheet. However, an air suction apparatus can be provided in the drive belt 130 to convey the sheet. The air suction apparatus serving as an air suction unit sucks the leading edge of the sheet. Further, an electrostatic attraction apparatus can be provided in the drive belt 130. The electrostatic attraction apparatus serving as an electrostatic attraction unit attracts the leading edge of the sheet using static electricity.

As described above, since the stacker 100 stacks sheets on two stacker trays 112*a* and 112*b*, its internal space can be used effectively.

Also, in the stacker 100 according to the embodiment of the present invention, the leading edge stopper 121 stops the leading edge of the sheet which falls on the stacker trays 112*a* and 112*b*, accordingly, alignment of the sheets can be improved.

Further, in the stacker 100 according to the embodiment of the present invention, the discharging portion discharges sheets one after another and the stopper stops the sheets, accordingly, a large number of sheets can be stacked on the sheets stacking portion at high speed.

Also, in the stacker 100 according to the embodiment of the present invention, the leading edge of the sheet abuts against the leading edge stopper 121 for alignment, accordingly, the risk of damage to the leading edge of the sheet is reduced.

Furthermore, the image forming apparatus 900 according to the embodiment of the present invention, includes the sheet stacking apparatus capable of stacking a large number of sheets, accordingly, a number of operation stops can be reduced, which contributes to improving efficiency in image forming.

In addition, since the image forming apparatus 900 has the stacker 100 which causes less damage to the leading edge of the sheet, necessity of re-forming the image is decreased, which improves image forming efficiency.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet stacking apparatus comprising:

a plurality of stacking portions arranged side by side, each stacking portion having a tray on which a sheet is stacked and which can move up and down separately ;

a discharging portion configured to discharge a sheet from one of a plurality of discharging positions to a corresponding stacking portion of the plurality of stacking portions selectively, each discharging position provided to correspond with each of the plurality of stacking portions;

a guiding unit which can move across the plurality of stacking portions and has a stopper that overlaps the tray on which there is no sheet so that a regulating surface of the stopper, regulating the sheet discharged from the selected discharging position to the tray of the corresponding stacking portion, intersects with a stacking surface of the tray and a guiding member that guides a downstream end in a discharge direction of the discharged sheet to the stopper; and a controller configured to control movement of the guiding unit so that the guiding unit is moved to a position where the stopper regulates the sheet discharged from the selected discharging position to the corresponding stacking portion.

2. The sheet stacking apparatus according to claim 1, wherein the discharging portion includes a gripper configured to grip and convey the sheet to the selected discharging position.

3. The sheet stacking apparatus according to claim 1, wherein the discharging portion is provided in each of the plurality of discharging positions.

4. The sheet stacking apparatus according to claim 1, wherein each tray of the plurality of stacking portions moves up and down separately so that a top surface of a sheet stack on the tray is positioned at a predetermined height.

5. The sheet stacking apparatus according to claim 1, wherein the guiding unit includes a rotating member configured to move the sheet discharged from the selected discharging position to the stopper.

6. An image forming apparatus comprising:

an image forming portion configured to form an image on a sheet; and a sheet stacking apparatus on which a sheet with an image formed thereon is stacked, the sheet stacking apparatus includes:

a plurality of stacking portions arranged side by side, each stacking portion having a tray on which the sheet is stacked and which can move up and down separately;

a discharging portion configured to discharge a sheet from one of a plurality of discharging positions to a corresponding stacking portion of the plurality of stacking portions selectively, each discharging position provided to correspond with each of the plurality of stacking portions;

a guiding unit which can move across the plurality of stacking portions and has a stopper that overlaps the tray on which there is no sheet so that a regulating surface of the stopper, regulating the sheet discharged from the selected discharging position to the tray of the corresponding stacking portion, intersects with a stacking surface of the tray and a guiding member that guides a downstream end in a discharge direction of the discharged sheet to the stopper; and a controller configured to control movement of the guiding unit so that the guiding unit is moved to a position where the stopper regulates the sheet discharged from the selected discharging position to the corresponding stacking portion.

7. The image forming apparatus according to claim 6, wherein the discharging portion includes a gripper configured to grip and convey the sheet to the selected discharging position.

8. The image forming apparatus according to claim 6, wherein the discharging portion is provided in each of the plurality of discharging positions.

9. The image forming apparatus according to claim 6, wherein each tray of the plurality of stacking portions moves up and down separately so that a top surface of a sheet stack on the tray is positioned at a predetermined height.

10. The image forming apparatus according to claim 6, wherein the guiding unit includes a rotating member configured to move the sheet discharged from the selected discharging position to the stopper.

* * * * *